US006407648B1

(12) United States Patent
Johnson

(10) Patent No.: US 6,407,648 B1
(45) Date of Patent: Jun. 18, 2002

(54) FOUR-WAY NON-DIRECTIONAL POWER COMBINER

(75) Inventor: Joseph M. Johnson, Brewster, NY (US)

(73) Assignee: Werlatone, Inc., Brewster, NY (US)

( * ) Notice: Subject to any disclaimer, the term of this patent is extended or adjusted under 35 U.S.C. 154(b) by 0 days.

(21) Appl. No.: 09/439,446

(22) Filed: Nov. 15, 1999

(51) Int. Cl.[7] ..... H01P 3/08; H01P 5/12
(52) U.S. Cl. ..... 333/127; 333/134
(58) Field of Search ..... 333/100, 124, 333/127, 125, 136

(56) References Cited

U.S. PATENT DOCUMENTS 5,434,610 A * 7/1995 Loveless ..... 348/6
5,483,208 A * 1/1996 Spriester ..... 333/131

* cited by examiner

*Primary Examiner*—Robert Pascal
*Assistant Examiner*—Kimberly E Glenn
(74) *Attorney, Agent, or Firm*—St. Onge Steward Johnston & Reens LLC

(57) ABSTRACT

A four-way non-directional power combiner employing cascaded 2:1 impedance step-up and step-down hybrid two-way combiners such that the use of additional impedance matching transformers is not required is disclosed. Unlike prior art combiners, the combiner disclosed employs a simple design which requires as few as eight transmission lines and four even mode impedance inhibitors, which may comprise ferrite cores. The non-directional signal combiner utilizes the inherent impedance transformation characteristics of a hybrid circuit in a four-way combiner, thereby eliminating the need for impedance matching transformers, and wherein the step-up and step-down hybrid circuits are interconnected in a balanced arrangement, thereby eliminating transmission line sections resulting in a shorter signal path with reduced losses from input to output.

24 Claims, 3 Drawing Sheets

FOUR-WAY NON-DIRECTIONAL POWER COMBINER

FIELD OF THE INVENTION

The present invention relates to a signal combining hybrid circuit, and more particularly to a broadband highly efficient in-phase four-way non-directional signal combiner.

BACKGROUND OF THE INVENTION

A common practice within the radio frequency component design and manufacturing industry is to cascade identical 2:1 impedance transforming hybrid or combiner circuits to form a four-way combiner. Such designs are disclosed, for example, in U.S. Pat. No. 3,192,490 to Petts and U.S. Pat. No. 4,774,481 to Edwards. These combiners transform the input impedance, commonly 50 ohms, to half the input level, or 25 ohms, at the output of the first stage, and then to one quarter of the input level, or 12.5 ohms, at the sum port of the second stage. Thus, a 4:1 impedance transformer is required at the sum port to bring the impedance back to 50 ohms. Such impedance transformers are undesirable, however, because their use increases overall cost of the combiner, increases overall weight of the combiner, and may degrade performance of the combiner.

In order overcome the disadvantages associated with requiring an impedance transformer, an alternative approach was developed wherein various arrangements of cascaded 2:1 impedance step-up and step-down hybrid two-way combiners are used to create a four-way combiner without the use of additional impedance matching transformers. Examples of such arrangements are disclosed in U.S. Pat. No. 3,413,574 to Schroeder and U.S. Pat. No. 3,317,849 to Smith-Vaniz. However, these designs suffer from disadvantages of their own. One such disadvantage is that the combiners disclosed in these patents are limited in frequency range. Another disadvantage is that the designs are quite complicated, requiring many circuit elements, thereby increasing cost, weight, and losses associated with circuit elements.

What is still needed, therefore, is a non-directional signal combiner which utilizes the inherent impedance transformation characteristics of a hybrid circuit in a four-way combiner, thereby eliminating the need for impedance matching transformers, and wherein the step-up and step-down hybrid circuits are interconnected in a balanced arrangement, thereby eliminating transmission line sections resulting in a shorter signal path with reduced losses from input to output.

SUMMARY OF THE INVENTION

An object, therefore, of the present invention is to provide a high power four-way power combiner which is simple in design and has a low production cost.

Another object of the present invention is to provide a high power four-way power combiner having the above characteristics and which employs transmission line sections having the same characteristic impedance to simplify the design and reduce costs of production.

Another object of the present invention is to provide a high power four-way power combiner having the above characteristics and which employs a reduced number of transmission line sections to reduce costs of production, and decrease losses.

An additional object of the present invention is to provide a high power four-way power combiner having the above characteristics and which employs isolating terminations of the same impedance to simplify the design and reduce costs of production.

A further object of the present invention is to provide a high power four-way power combiner having the above characteristics and which employs a reduced number of magnetic cores to simplify the design, reduce costs of production, reduce weight and decrease losses.

Yet another object of the present invention is to provide a high power four-way power combiner having the above characteristics and which can be easily, scaled to suit power requirements from a few watts to several kilowatts.

Still another object of the present invention to provide a high power four-way power combiner having the above characteristics and which employs a relatively short signal path length to reduce losses.

These and other objects of the present invention are achieved by a non-directional signal combiner having first, second, third and fourth transmission lines, each having an inner conductor and an outer conductor, and each having first and second ends. The first ends of the inner conductors of the first, second, third and fourth transmission lines are for receiving input signals and may be connected to a coaxial cable connector, for example. The first ends of the outer conductors of the first, second, third and fourth transmission lines are connected to a ground plane.

The signal combiner also includes fifth and sixth transmission lines, each having an inner conductor and an outer conductor, and each having first and second ends. The first end of the inner conductor of the fifth transmission line is connected to the second end of the inner conductor of the second transmission line, the first end of the inner conductor of the sixth transmission line is connected to the second end of the inner conductor of the third transmission line, the first end of the outer conductor of the fifth transmission line is connected to the second end of the outer conductor of the first transmission line, the first end of the outer conductor of the sixth transmission line is connected to the second end of the outer conductor of the fourth transmission line, and the second ends of the inner conductors of the fifth and sixth transmission lines are connected together to form a signal output, and may be connected to a coaxial cable connection, for example.

Seventh and eighth transmission lines are also included, each having an inner conductor and an outer conductor, and each having first and second ends. The first end of the inner conductor of the seventh transmission line is connected to the second end of the inner conductor of the first transmission line, the first end of the inner conductor of the eighth transmission line is connected to the second end of the inner conductor of the fourth transmission line, the second end of the inner conductor of the seventh transmission line is connected to the second end of the outer conductor of the sixth transmission line, the second end of the inner conductor of the eighth transmission line is connected to the second end of the outer conductor of the fifth transmission line, the first end of the outer conductor of the seventh transmission line is connected to the second end of the outer conductor of the second transmission line, the first end of the outer conductor of the eighth transmission line is connected to the second end of the outer conductor of the third transmission line, and the second ends of the outer conductors of the seventh and eighth transmission lines are connected to the ground plane.

In one embodiment the interconnection between the second end of the outer conductor of the first transmission line and the first end of the outer conductor of the fifth transmission line and the interconnection between the second end of the outer conductor of the fourth transmission line and the first end of the outer conductor of the sixth transmission line are connected to the ground plane. When this is the case, even mode impedance inhibitors are employed on the second, third, fifth, sixth, seventh and eighth transmission lines to inhibit flow of current on the outer surfaces of the outer conductors of the second, third, fifth, sixth, seventh and eighth transmission lines.

In another embodiment, the interconnection between the second end of the outer conductor of the second transmission line and the first end of the outer conductor of the seventh transmission line and the interconnection between the second end of the outer conductor of the third transmission line and the first end of the outer conductor of the eighth transmission line are connected to the ground plane. When this is the case, even mode impedance inhibitors are employed on the first, fourth, fifth and sixth transmission lines to inhibit flow of current on the outer surfaces of the outer conductors of the first, fourth, fifth and sixth transmission lines.

Other objects, advantages and novel features of the invention will become apparent from the following detailed description of the invention when considered in conjunction with the accompanying drawings.

DETAILED DESCRIPTION OF THE INVENTION

Figure 1:
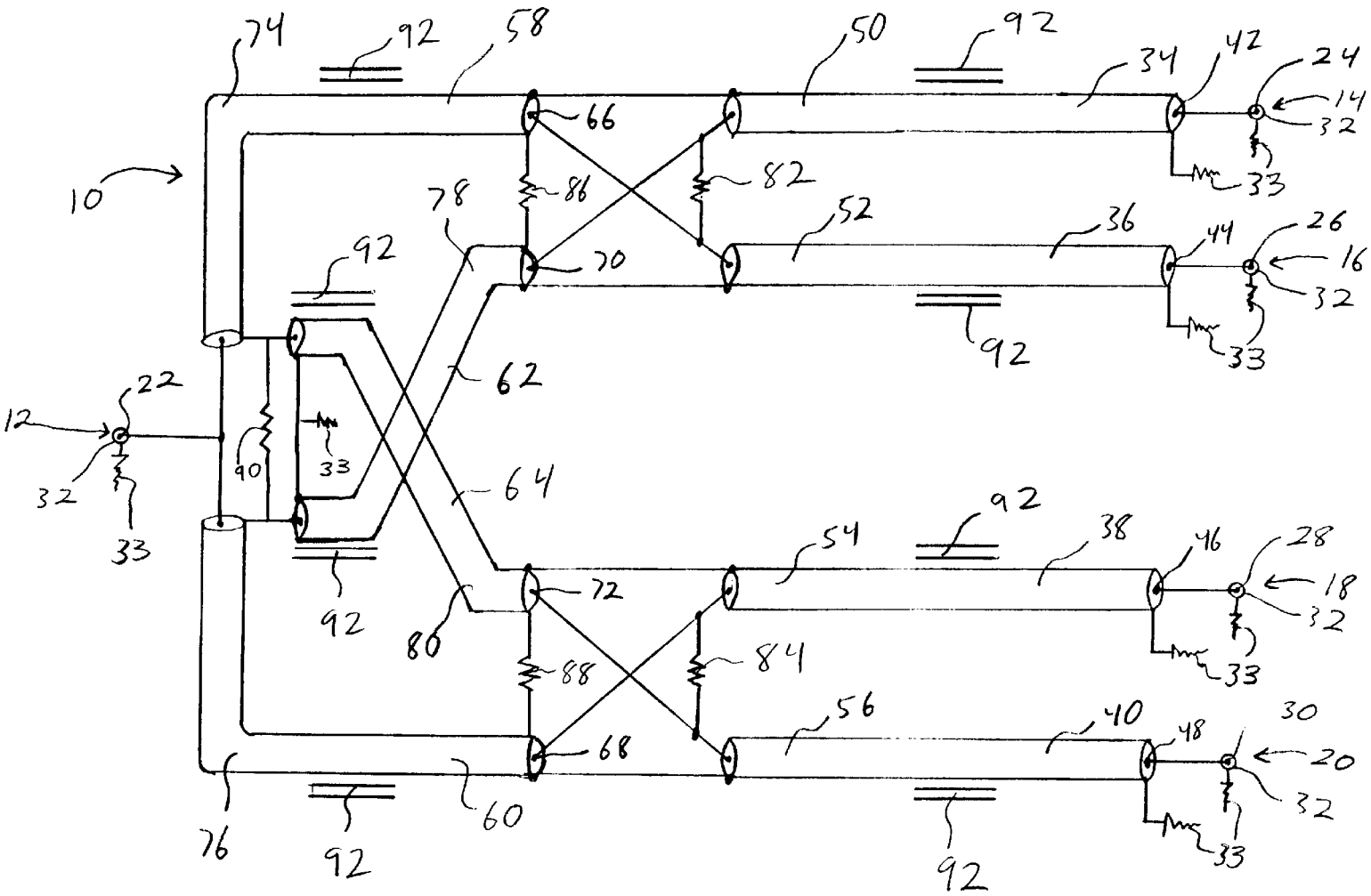
FIG. 1 is a schematic representation of a first embodiment of a four-way power combiner according to the present invention.

Referring first to FIG. 1, a schematic representation of a four-way power combiner 10 is shown. It should be understood that, although the combiner may function either as a combiner or divider depending upon the manner of usage, for the sake of simplicity it will be referred to as a "non-directional combiner" with the understanding that both functions are included within that term. In addition, the terms "input" and "output" are interchangeable depending on whether the non-directional combiner is being used as a combiner or a divider; and when one is referred to in either the specification or the appended claims, the other is also included.

The combiner 10 includes an output sum port 12 and four input ports 14, 16, 18, 20. All of the ports 12, 14, 16, 18, 20 are preferably coaxial cable connectors having, respectively, inner conductors 22, 24, 26, 28, 30 and outer conductors 32 with the outer conductors 32 connected to a common ground plane (indicated as 33). Combiner 10 also includes first, second, third and fourth coaxial cables 34, 36, 38, 40 having respectively inner conductors 42, 44, 46, 48 and outer conductors 50, 52, 54, 56. Inner conductor 42 is connected at a first end of coaxial cable 34 to inner conductor 24 of input port 14, while outer conductor 50 of coaxial cable 34 is connected at the first end of coaxial cable 34 to common ground plane 33. Similarly, inner conductors 44, 46, 48 are connected at first ends of coaxial cables 36, 38, 40 to inner conductors 26, 28, 30 of input ports 16, 18, 20 respectively, while outer conductors 52, 54, 56 are connected to common ground plane 33 at the first ends of coaxial cables 36, 38, 40.

Combiner 10 further includes fifth, sixth, seventh and eighth coaxial cables 58, 60, 62, 64 having respectively inner conductors 66, 68, 70, 72 and outer conductors 74, 76, 78, 80. Inner conductor 66 of coaxial cable 58 is connected at a first end of coaxial cable 58 to inner conductor 44 of coaxial cable 36 at a second end of coaxial cable 36, while inner conductor 66 of coaxial cable 58 is connected at a second end of coaxial cable 58 to inner conductor 22 of output port 12. Similarly, inner conductor 68 of coaxial cable 60 is connected at a first end of coaxial cable 60 to inner conductor 46 of coaxial cable 38 at a second end of coaxial cable 38, while inner conductor 68 of coaxial cable 60 is connected at a second end of coaxial cable 60 to inner conductor 22 of output port 12. Outer conductor 74 of coaxial cable 58 is connected at the first end of coaxial cable 58 to outer conductor 50 of coaxial cable 34 at a second end of coaxial cable 34 and outer conductor 76 of coaxial cable 60 is connected at the first end of coaxial cable 60 to outer conductor 56 of coaxial cable 40 at a second end of coaxial cable 40.

Inner conductor 70 of coaxial cable 62 is connected at a first end of coaxial cable 62 to inner conductor 42 of coaxial cable 34 at the second end of coaxial cable 34, while inner conductor 70 of coaxial cable 62 is connected at a second end of coaxial cable 62 to outer conductor 76 of coaxial cable 60 at the second end of coaxial cable 60. Similarly, inner conductor 72 of coaxial cable 64 is connected at a first end of coaxial cable 64 to inner conductor 48 of coaxial cable 40 at the second end of coaxial cable 40, while inner conductor 72 of coaxial cable 64 is connected at a second end of coaxial cable 64 to outer conductor 74 of coaxial cable 58 at the second end of coaxial cable 58. Outer conductor 78 of coaxial cable 62 is connected at the first end of coaxial cable 62 to outer conductor 52 of coaxial cable 36 at the second end of coaxial cable 36, while outer conductor 78 of coaxial cable 62 is connected at the second end of coaxial cable 62 to common ground plane 33. Similarly, outer conductor 80 of coaxial cable 64 is connected at the first end of coaxial cable 64 to outer conductor 54 of coaxial cable 38 at the second end of coaxial cable 38, while outer conductor 80 of coaxial cable 64 is connected at the second end of coaxial cable 64 to common ground plane 33.

Combiner 10 may also include dissipaters for dissipating unbalanced power within the circuit. A first dissipater 82 may be connected between inner conductor 42 of coaxial cable 34 and inner conductor 44 of coaxial cable 36 at the second ends of coaxial cables 34, 36 and a second dissipater 84 may be connected between inner conductor 46 of coaxial cable 38 and inner conductor 48 of coaxial cable 40 at the second ends of coaxial cables 38, 40. A third dissipater 86 may be connected between outer conductor 74 of coaxial cable 58 and outer conductor 78 of coaxial cable 62 at the first ends of coaxial cables 58, 62 and a fourth dissipater 88 may be connected between outer conductor 76 of coaxial cable 60 and outer conductor 80 of coaxial cable 64 at the first ends of coaxial cables 60, 64. A fifth dissipater 90 may be connected between inner conductor 70 of coaxial cable 62 and inner conductor 72 of coaxial cable 64 at the second ends of coaxial cables 62, 64. Preferably, dissipaters 82, 84, 86, 88, 90 comprise isolation resistors as shown in the Figures.

Each of coaxial cables 34, 36, 38, 40, 58, 60, 62, 64 incorporate even mode impedance inhibitors 92 to minimize the effect of even mode impedances between the coaxial cables and the ground plane. In other words, even mode impedance inhibitors 92 inhibit the flow of current on the surfaces of the outer conductors of the coaxial cables. Even mode impedance inhibitors 92 preferably take the form of magnetic cores, although it should be understood that other methods, such as winding the coaxial cables into air coils can be employed. When magnetic cores are employed, the magnetic cores are preferably formed from a ferrite material, and may take the form of a toroid, a squaroid, a sleeve or any of other numerous know appropriate shapes. In addition, the coaxial cables may pass straight through the magnetic cores, or may be wound around the cores one or more times. For normal applications, a squaroid is preferred because such a shape is relatively easy to heat sink. However, for some very high power applications a binocular core with multiple turns may be preferred.

As should be apparent, the above-described circuit arrangement employs eight transmission line sections and eight magnetic cores. This is a significant improvement over the prior art, for example U.S. Pat. No. 4,774,481 to Edwards, which requires fourteen transmission line sections and thirteen magnetic cores. Moreover, if all four input ports and the output port have an impedance of 50 ohms, which is typically the case, then the present invention would employ all 50 ohm transmission line sections and 50 ohm isolation terminations. On the other hand, Edwards would require ten 50 ohm transmission line sections, four 25 ohm transmission line sections, four 50 ohm isolation terminations and two 25 ohm isolation terminations. As should be clear to one in the art, the present invention thus provides numerous advantages over the prior art with respect to simplicity of design, cost of production, decrease in weight and improved loss characteristics.

Figure 2:
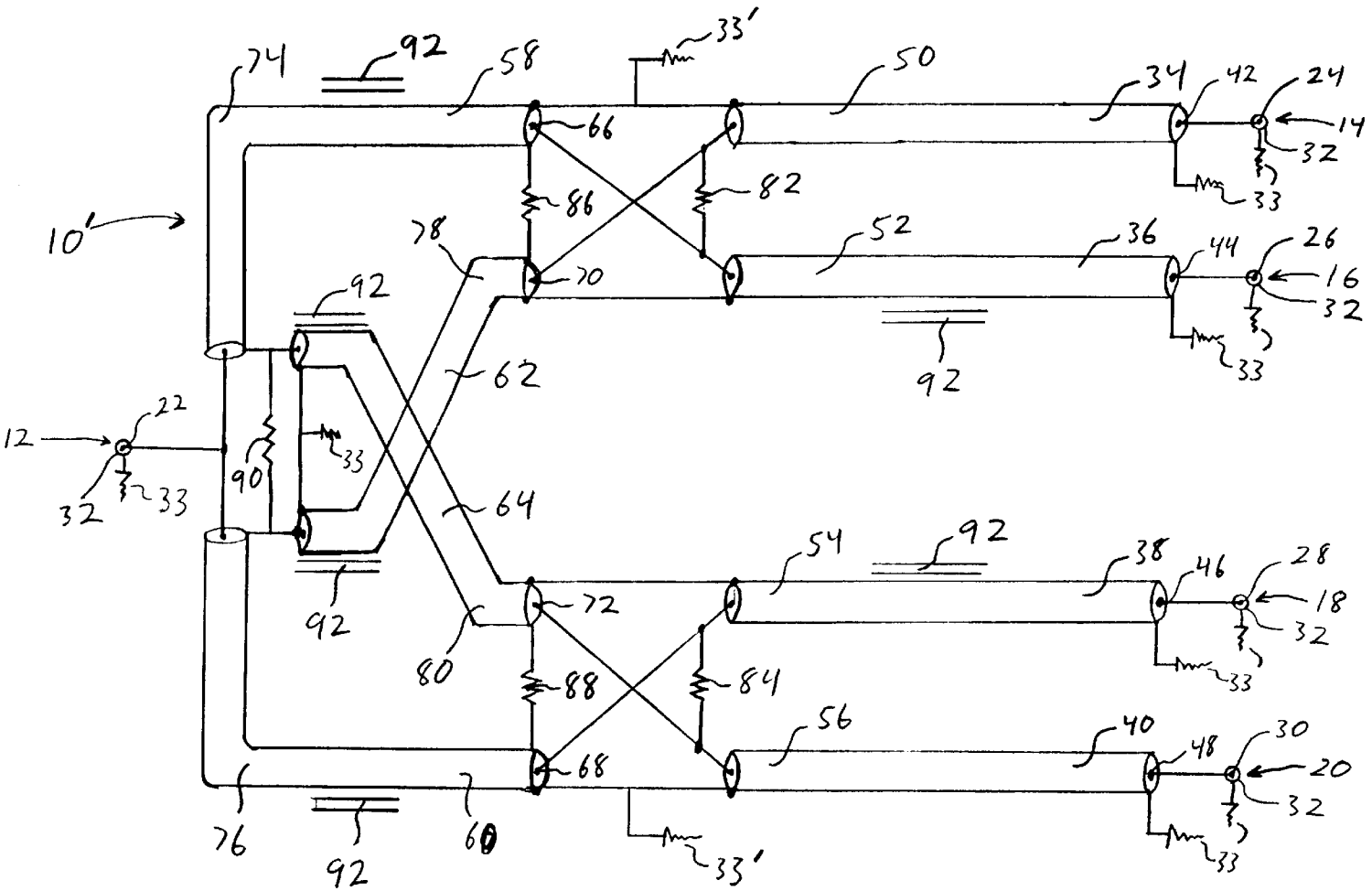
FIG. 2 is a schematic representation of a second embodiment of a four-way power combiner according to the present invention.

Referring now to FIG. 2, wherein like elements are referred to with like reference numerals, a second embodiment of the four-way power combiner 10' is shown. In this embodiment, grounds 33' are placed on the interconnection between outside conductor 50 of coaxial cable 34 and outside conductor 74 of coaxial cable 58 and on the interconnection between outside conductor 56 of coaxial cable 40 and outside conductor 76 of coaxial cable 60. This change results in coaxial cables 34, 40 being grounded at both ends, which causes coaxial cables 34, 40 to act as delay lines, thus requiring no even mode impedance inhibitors to be employed therewith. As a result, combiner 10' still requires eight transmission line sections, but only six magnetic cores, a 25% reduction of cores over combiner 10 shown in FIG. 1, and an even greater improvement over the prior art.

Figure 3:
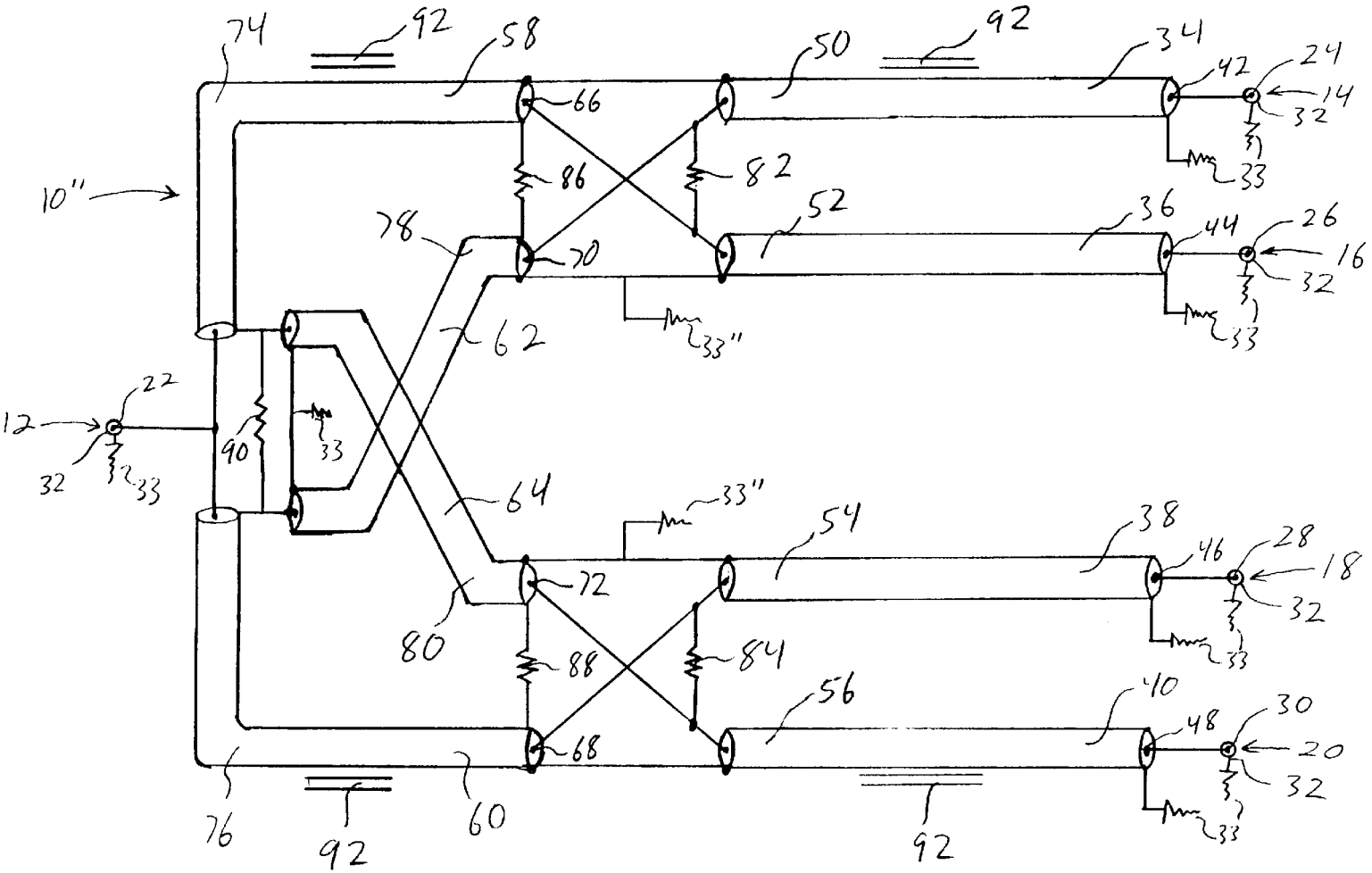
FIG. 3 is a schematic representation of a third embodiment of a four-way power combiner according to the present invention.

Referring now to FIG. 3, wherein like elements are referred to with like reference numerals, a third embodiment of the four-way power combiner 10" is shown. In this embodiment, grounds 33" are placed on the interconnection between outside conductor 52 of coaxial cable 36 and outside conductor 78 of coaxial cable 62 and on the interconnection between outside conductor 54 of coaxial cable 38 and outside conductor 80 of coaxial cable 64. This change results in coaxial cables 36, 38, 62, 64 being grounded at both ends, which causes coaxial cables 36, 38, 62, 64 to act as delay lines, thus requiring no even mode impedance inhibitors to be employed therewith. As a result, combiner 10" still requires eight transmission line sections, but only four magnetic cores, a 50% reduction of cores over combiner 10 shown in FIG. 1, a 33% reduction of cores over combiner 10' shown in FIG. 2, and an even greater improvement over the prior art.

Three embodiments of an improved hybrid power combiner capable of an operational bandwidth of two or more decades have been described herein. All three embodiments exhibit nearly identical results, and a preferred embodiment may depend on the specific application for which the combiner is to be used. During testing, the combiner 10' of FIG. 2 resulted in a slightly lower overall loss and better amplitude balance between input ports over extremely wide bandwidths. For narrower band applications, such as 1.5–32 MHz, 20–100 MHz, or 1–300 MHz, the combiner 10" of FIG. 3 has significant weight and cost advantages with excellent electrical specifications.

Typical specifications for a 1 kW combiner covering 2–32 MHz include 0.15 dB insertion loss, 35 dB minimum isolation between input ports, 1.1:1 voltage standing wave ratio (VSWR) at all ports and phase balance of 0.5 degrees. This same combiner when measured between 0.5 and 150 MHz provided a maximum insertion loss of 0.3 dB, 25 dB minimum isolation between input ports, 1.15:1 VSWR at all ports and phase balance of less than 2 degrees.

At 7 Kw, 1–32 MHz combiners were constructed using all three embodiments. Results included 0.15 dB maximum insertion loss, 20 dB minimum isolation and 1.1:1 VSWR on all ports. The same combiners measured from 0.5–50 MHz exhibited 0.2 dB maximum loss, 20 dB minimum isolation and 1.15:1 maximum VSWR. The combiner 10" constructed in accordance with FIG. 3 provided slightly better amplitude balance between ports, less than 0.06 dB. Moreover, the 7 Kw combiners constructed in accordance with the present invention were significantly smaller than the prior art combiners previously available.

Additional combiners capable of 500 watts or more of power were constructed covering the 1–300 and 20–500 MHz ranges and exhibited insertion loss characteristics of approximately 0.3 dB and 20 dB isolation.

The present invention therefore provides a non-directional signal combiner which utilizes the inherent impedance transformation characteristics of a hybrid circuit in a four-way combiner, thereby eliminating the need for impedance matching transformers, and wherein the step-up and step-down hybrid circuits are interconnected in a balanced arrangement, thereby eliminating transmission line sections resulting in a shorter signal path with reduced losses from input to output.

Although the invention has been described with reference to a particular arrangement of parts, features and the like, these are not intended to exhaust all possible arrangements or features, and indeed, many other modifications and variations will be ascertainable to those skilled in the art.

What is claimed is:

1. A non-directional signal combiner comprising:

first, second, third and fourth transmission lines, each having an inner conductor and an outer conductor, and each having first and second ends, the first ends of the inner conductors of said first, second, third and fourth transmission lines being for receiving input signals, and the first ends of the outer conductors of said first, second, third and fourth transmission lines being connected to a ground plane;

fifth and sixth transmission lines, each having an inner conductor and an outer conductor, and each having first and second ends, the first end of the inner conductor of said fifth transmission line being connected to the second end of the inner conductor of said second transmission line, the first end of the inner conductor of said sixth transmission line being connected to the second end of the inner conductor of said third transmission line, the first end of the outer conductor of said fifth transmission line being connected to the second end of the outer conductor of said first transmission line, the first end of the outer conductor of said sixth transmission line being connected to the second end of the outer conductor of said fourth transmission line, and the second ends of the inner conductors of said fifth and sixth-transmission lines being connected together to form a signal output;

seventh and eighth transmission lines, each having an inner conductor and an outer conductor, and each having first and second ends, the first end of the inner conductor of said seventh transmission line being connected to the second end of the inner conductor of said first transmission line, the first end of the inner conductor of said eighth transmission line being connected to the second end of the inner conductor of said fourth transmission line, the second end of the inner conductor of said seventh transmission line being connected to the second end of the outer conductor of said sixth transmission line, the second end of the inner conductor of said eighth transmission line being connected to the second end of the outer conductor of said fifth transmission line, the first end of the outer conductor of said seventh transmission line being connected to the second end of the outer conductor of said second transmission line, the first end of the outer conductor of said eighth transmission line being connected to the second end of the outer conductor of said third transmission line, and the second ends of the outer conductors of said seventh and eighth transmission lines being connected to the ground plane;

wherein the interconnection between the second end of the outer conductor of said first transmission line and the first end of the outer conductor of said fifth transmission line and the interconnection between the second end of the outer conductor of said fourth transmission line and the first end of the outer conductor of said sixth transmission line are connected to the ground plane;

even mode impedance inhibitors employed on said second, third, fifth, sixth, seventh and eighth transmission lines to inhibit flow of current on the outer surfaces of the outer conductors of said second, third, fifth, sixth, seventh and eighth transmission lines; and wherein said first, second, third, fourth, fifth, sixth, seventh and eighth transmission lines all have the same characteristic impedance.

2. A non-directional signal combiner according to claim 1 wherein at least one of said even mode impedance inhibitors comprises a piece of magnetic material.

3. A non-directional signal combiner according to claim 2 wherein the piece of magnetic material comprises a piece of ferrite.

4. A non-directional signal combiner according to claim 2 wherein the piece of magnetic material has a hole passing therethrough, with the transmission line on which said even mode impedance inhibitor is employed passing through the hole.

5. A non-directional signal combiner according to claim 1 wherein at least one of said even mode impedance inhibitors comprises an air coil.

6. A non-directional signal combiner according to claim 1 wherein said first, second, third, fourth, fifth, sixth, seventh and eighth transmission lines comprise coaxial cables.

7. A non-directional signal combiner according to claim 1 further comprising an output port and first, second, third and fourth input ports, the first end of the inner conductor of said first transmission line being connected to said first input port, the first end of the inner conductor of said second transmission line being connected to said second input port, the first end of the inner conductor of said third transmission line being connected to said third input port, the first end of the inner conductor of said fourth transmission line being connected to said fourth input port, and the second ends of the inner conductors of said fifth and sixth transmission lines being connected to said output port.

8. A non-directional signal combiner according to claim 7 wherein said output port and first, second, third and fourth input ports comprise coaxial cable connectors each having an inner conductor and an outer conductor, the inner conductors of said first, second, third, fourth, fifth and sixth transmission lines being connected to the inner conductor of the port to which it is connected, and the outer conductor of each port connected to ground.

9. A non-directional signal combiner according to claim 1 further comprising first and second dissipaters for dissipating unbalanced power, said first dissipater connected between the interconnection of the second end of the inner conductor of said first transmission line and the first end of the inner conductor of said seventh transmission line and the interconnection of the second end of the inner conductor of said second transmission line and the first end of the inner conductor of said fifth transmission line, and said second dissipater connected between the interconnection of the second end of the inner conductor of said fourth transmission line and the first end of the inner conductor of said eighth transmission line and the interconnection of the second end of the inner conductor of said third transmission line and the first end of the inner conductor of said sixth transmission line.

10. A non-directional signal combiner according to claim 9 further comprising third and fourth dissipaters for dissipating unbalanced power, said third dissipater connected between the interconnection of the second end of the outer conductor of said first transmission line and the first end of the outer conductor of said fifth transmission line and the interconnection of the second end of the outer conductor of said second transmission line and the first end of the outer conductor of said seventh transmission line, and said second dissipater connected between the interconnection of the second end of the outer conductor of said fourth transmission line and the first end of the outer conductor of said sixth transmission line and the interconnection of the second end of the outer conductor of said third transmission line and the first end of the outer conductor of said eighth transmission line.

11. A non-directional signal combiner according to claim 10 further comprising a fifth dissipater for dissipating unbalanced power, said fifth dissipater connected between the interconnection of the second end of the inner conductor of said seventh transmission line and the second end of the outer conductor of said sixth transmission line and the interconnection of the second end of the inner conductor of said eighth transmission line and the second end of the outer conductor of said fifth transmission line.

12. A non-directional signal combiner according to claim 11 wherein said first, second, third, fourth and fifth dissipaters comprise isolating resisters all having the same resistance.

13. A non-directional signal combiner comprising:

first, second, third and -fourth transmission lines, each having an inner conductor and an outer conductor, and each having first and second ends, the first ends of the inner conductors of said first, second, third and fourth transmission lines being for receiving input signals, and the first ends of the outer conductors of said first, second, third and fourth transmission lines being connected to a ground plane;

fifth and sixth transmission lines, each having an inner conductor and an outer conductor, and each having first and second ends, the first end of the inner conductor of said fifth transmission line being connected to the second end of the inner conductor of said second transmission line, the first end of the inner conductor of said sixth transmission line being connected to the second end of the inner conductor of said third transmission line, the first end of the outer conductor of said fifth transmission line being connected to the second end of the outer conductor of said first transmission line, the first end of the outer conductor of said sixth transmission line being connected to the second end of the outer conductor of said fourth transmission line, and the second ends of the inner conductors of said fifth and sixth transmission lines being connected together to form a signal output;

seventh and eighth transmission lines, each having an inner conductor and an outer conductor, and each having first and second ends, the first end of the inner conductor of said seventh transmission line being connected to the second end of the inner conductor of said first transmission line, the first end of the inner conductor of said eighth transmission line being connected to the second end of the inner conductor of said fourth transmission line, the second end of the inner conductor of said seventh transmission line being connected to the second end of the outer conductor of said sixth transmission line, the second end of the inner conductor of said eighth transmission line being connected to the second end of the outer conductor of said fifth transmission line, the first end of the outer conductor of said seventh transmission line being connected to the second end of the outer conductor of said second transmission line, the first end of the outer conductor of said eighth transmission line being connected to the second end of the outer conductor of said third transmission line, and the second ends of the outer conductors of said seventh and eighth transmission lines being connected to the ground plane;

wherein the interconnection between the second end of the outer conductor of said second transmission line and the first end of the outer conductor of said seventh transmission line and the interconnection between the second end of the outer conductor of said third transmission line and the first end of the outer conductor of said eighth transmission line are connected to the ground plane;

even mode impedance inhibitors employed on said first, fourth, fifth and sixth transmission lines to inhibit flow of current on the outer surfaces of the outer conductors of said first, fourth, fifth and sixth transmission lines; and wherein said first, second, third, fourth, fifth, sixth, seventh and eighth transmission lines all have the same characteristic impedance.

14. A non-directional signal combiner according to claim 13 wherein at least one of said even mode impedance inhibitors comprises a piece of magnetic material.

15. A non-directional signal combiner according to claim 14 wherein the piece of magnetic material comprises a piece of ferrite.

16. A non-directional signal combiner according to claim 14 wherein the piece of magnetic material has a hole passing therethrough, with the transmission line on which said even mode impedance inhibitor is employed passing through the hole.

17. A non-directional signal combiner according to claim 13 wherein at least one of said even mode impedance inhibitors comprises an air coil.

18. A non-directional signal combiner according to claim 13 wherein said first, second, third, fourth, fifth, sixth, seventh and eighth transmission lines comprise coaxial cables.

19. A non-directional signal combiner according to claim 13 further comprising an output port and first, second, third and fourth input ports, the first end of the inner conductor of said first transmission line being connected to said first input port, the first end of the inner conductor of said second transmission line being connected to said second input port, the first end of the inner conductor of said third transmission line being connected to said third input port, the first end of the inner conductor of said fourth transmission line being connected to said fourth input port, and the second ends of the inner conductors of said fifth and sixth transmission lines being connected to said output port.

20. A non-directional signal combiner according to claim 19 wherein said output port and first, second, third and fourth input ports comprise coaxial cable connectors each having an inner conductor and an outer conductor, the inner conductors of said first, second, third, fourth, fifth and sixth transmission lines being connected to the inner conductor of the port to which it is connected, and the outer conductor of each port connected to ground.

21. A non-directional signal combiner according to claim 13 further comprising first and second dissipaters for dissipating unbalanced power, said first dissipater connected between the interconnection of the second end of the inner conductor of said first transmission line and the first end of the inner conductor of said seventh transmission line and the interconnection of the second end of the inner conductor of said second transmission line and the first end of the inner conductor of said fifth transmission line, and said second dissipater connected between the interconnection of the second end of the inner conductor of said fourth transmission line and the first end of the inner conductor of said eighth transmission line and the interconnection of the second end of the inner conductor of said third transmission line and the first end of the inner conductor of said sixth transmission line.

22. A non-directional signal combiner according to claim 21 further comprising third and fourth dissipaters for dissipating unbalanced power, said third dissipater connected between the interconnection of the second end of the outer conductor of said first transmission line and the first end of the outer conductor of said fifth transmission line and the interconnection of the second end of the outer conductor of said second transmission line and the first end of the outer conductor of said seventh transmission line, and said second dissipater connected between the interconnection of the second end of the outer conductor of said fourth transmission line and the first end of the outer conductor of said sixth transmission line and the interconnection of the second end of the outer conductor of said third transmission line and the first end of the outer conductor of said eighth transmission line.

23. A non-directional signal combiner according to claim 22 further comprising a fifth dissipater for dissipating unbalanced power, said fifth dissipater connected between the interconnection of the second end of the inner conductor of said seventh transmission line and the second end of the outer conductor of said sixth transmission line and the interconnection of the second end of the inner conductor of said eighth transmission line and the second end of the outer conductor of said fifth transmission line.

24. A non-directional signal combiner according to claim 23 wherein said first, second, third, fourth and fifth dissipaters comprise isolating resisters all having the same resistance.

* * * * *